US005167408A

United States Patent [19]

Golicz

[11] Patent Number: 5,167,408

[45] Date of Patent: Dec. 1, 1992

[54] HIGH CAPACITY SHEET FEEDERS FOR HIGH VOLUME PRINTERS

[75] Inventor: Roman M. Golicz, Clinton, Conn.

[73] Assignee: Intelligent Technologies Corporation, Old Saybrook, Conn.

[21] Appl. No.: 775,200

[22] Filed: Oct. 9, 1991

[51] Int. Cl.[5] ..... B65H 1/02

[52] U.S. Cl. ..... 271/149; 271/152; 271/157; 271/162

[58] Field of Search ..... 271/149, 152, 153, 157, 271/161, 162

[56] References Cited

U.S. PATENT DOCUMENTS 1,396,622 11/1921 Bullen et al. ..... 271/149 X
2,992,820 7/1961 Tarbuck et al. ..... 271/153 X
3,240,488 3/1966 Lyman ..... 271/149

*Primary Examiner*—David H. Bollinger

*Attorney, Agent, or Firm*—Wolf, Greenfield & Sacks

[57] ABSTRACT

A multi-ream paper sheet feeder for use with high speed copiers, printing machines and the like "host machines" has a sturdy frame supporting an upwardly sloping ramp overlying a motor driven feed screw. A pusher plate drives a feed block of as many as thirty reams of edgewise stacked paper sheets up the ramp to a singulating feed assembly. A feed screw drive nut carriage engages and drives the pusher plate up ramp, then disengages, retracts under the ramp and travels to a new start position at the ramp's lower end. Sensors and limit switches govern forward and reverse feed screw motor operation; another sensor governs the operation of the singulating feed assembly, delivering shingled sheets on demand to the feeder's infeed tray. The entire sheet feeder is track-mounted, latched in feed position, disengageable for retraction away from the host machine when desired.

18 Claims, 11 Drawing Sheets

HIGH CAPACITY SHEET FEEDERS FOR HIGH VOLUME PRINTERS

This invention relates to extremely high capacity sheet feeders, for supplying a block of as many as thirty reams of paper sheets, automatically fed to the infeed mechanism of such high volume printers as the Xerox printer model 9500, 9700, 4090, photocopiers or other sheet paper using "host" machines.

RELATED ART

These high volume copiers or cut sheet printers are each provided with paper supply feed mechanisms, consisting of an elevator platform adapted for vertical elevation. A variable capacity stack of paper sheets, generally 500 to 4,000 sheets, is placed on the platform, which is elevated on command until the uppermost sheet contacts the printer's feed mechanism. The ascent of the paper stack is stopped by the printer's feed mechanism limit switch.

As the uppermost paper sheets are fed into the printer, the limit switch is deactivated, thus raising the platform and the remaining stack of paper sheets until the cycle is repeated.

When this load of sheets has been fed through the copier or printer, a "reload" time of between two and five minutes may be required to place up to eight more reams of paper sheets on the tray in succession, with proper edge alignment for feed registration. The loading operation, therefore, consumes between 10 and 25% of the printer's total operating time.

BRIEF SUMMARY OF THE INVENTION

The slanting loading ramp and feed mechanism of this sheet feeder invention permits as many as thirty reams or 15,000 sheets of paper to be loaded and aligned as an elongated block or feed stock column, at the user's convenience, without interfering with the printer's normal high volume printing operations. A very brief interruption permits the loading ramp of the present invention to advance its total feed stock column into feeding position, and the counterbalanced infeed tray of the feeder is already in the feeding position, ready to continue resupplying the printer.

When access to the infeed tray of the high volume printer is desired for normal operation, adjustments, inspection or maintenance, the totality of the present invention can be unlatched and rolled away along an underlying track, providing ample access to all sides of the host machine.

These high volume copiers and printers take their infeed sheets from the top of the sheet stack on the elevator tray. As long as the level and hence the position of the top of the paper stack does not vary by more than approximately five to eight sheets, the elevator tray will not receive the ascend signal from the printer's feed mechanism limit switch. Therefore, once the paper stack normally placed on the elevator tray by the operator is replaced by the similar stack of paper resting on the counterbalanced infeed tray of the high capacity feeder, the printer's feeding mechanism is unable to distinguish between the two. The loading ramp devices of the present invention feed fresh shingled sheets to the bottom of the stack on the feeder's counterbalanced infeed tray, employing a unique singulating and/or shingling feed mechanism which has the additional advantage of avoiding snagging of any perforations along the edges or body of the sheets being delivered to the underside of the stack on the counterbalanced infeed tray of the high capacity feeder. The level of the stack is maintained through the use of a level sensing bar which controls the resupply on demand whenever three to five sheets are needed.

It is a principal object of the present invention to provide high capacity sheet feeders for highly efficient supply of paper sheets to high volume printers, copying machines, etc., without the need of communicating with the host machine, minimizing or eliminating printer downtime for infeed sheet loading.

Another object of the invention is to provide such high capacity sheet feeders employing an upsloping diagonal loading ramp capable of carrying as many as thirty reams of paper sheets.

Still another object of the invention is to provide such sheet feeding devices which are capable of singulating and/or shingling sheets fed from the device to the underside of an infeed sheet stack on the feeder's counterbalanced infeed tray platform, and presenting the platform and stack to a high volume printer or similar machine.

A further object of the invention is to singulate and/or shingle the paper sheets delivered to the infeed platform in an overlapping feed stream sufficiently fanned to eliminate inter-sheet "fibre-lock" friction force in order to insure that the infeed paper sheet stack is in optimum condition for single sheet feeding through the high volume printer or other machine.

Another object of the invention is to provide automatic feed advance of the entire multiream column of sheets to be delivered to the feeder's counterbalanced infeed tray platform, thus providing automatic and continuous resupply of singulated shingled sheets to the host machine's feeding mechanism.

Still another object of the invention is to provide high capacity sheet feed loaders of this character with fail safe and foolproof limit switches, avoiding the possibility of jamming or interruption of normal feed operations, and of damage to the host machine.

Other objects of the invention will in part be obvious and will in part appear hereinafter.

The invention accordingly comprises the features of construction, combination of elements, and arrangement of parts which will be exemplified in the construction hereinafter set forth, and the scope of the invention will be indicated in the claims.

THE DRAWINGS

For a fuller understanding of the nature and objects of the invention, reference should be made to the following detailed description taken in connection with the accompanying drawings, in which.

BEST MODE FOR CARRYING OUT THE INVENTION

Figure 1:
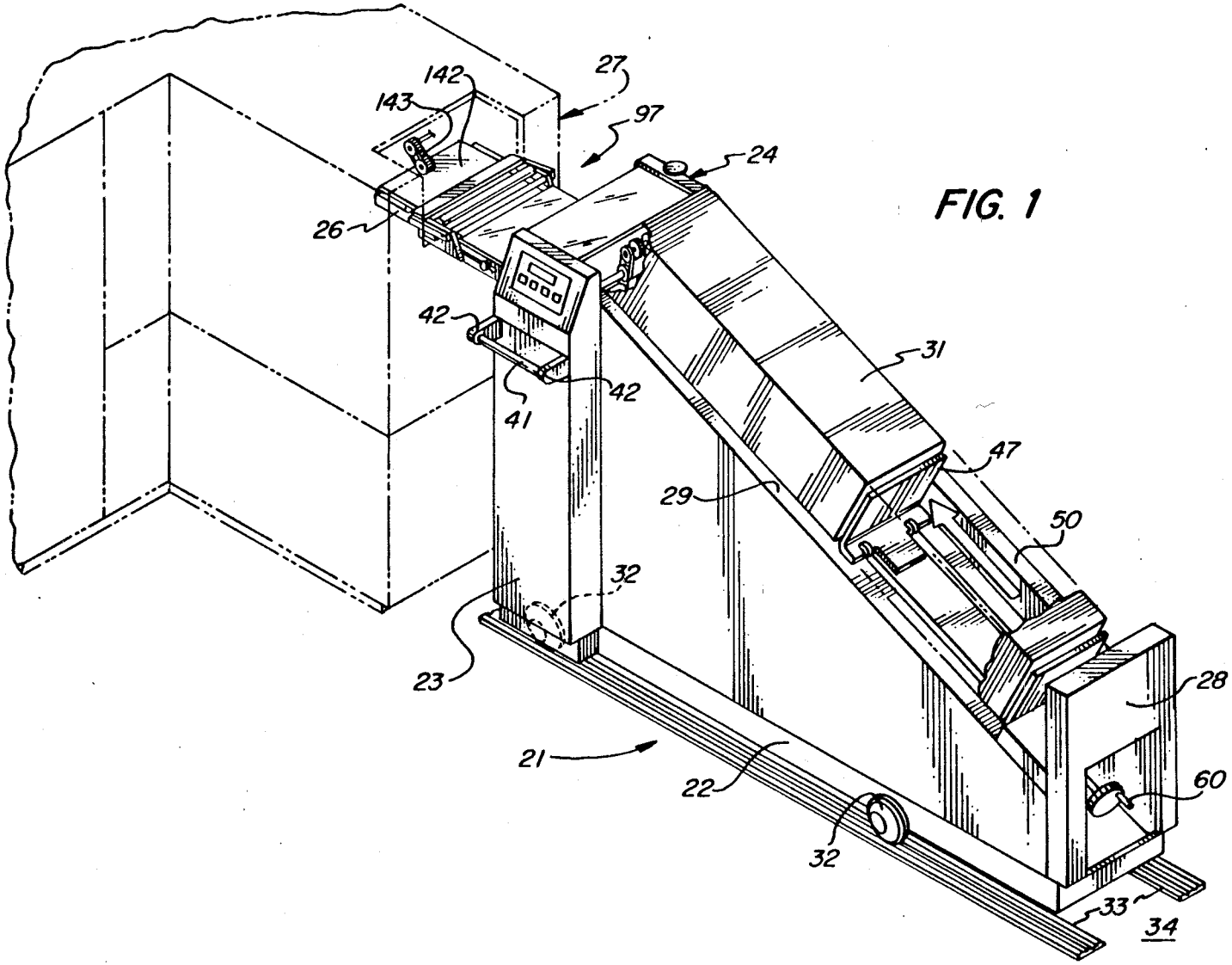
FIG. 1 is a perspective diagrammatic view of the high capacity sheet feeder of the present invention shown in operating position with its counterbalanced infeed tray under the feed mechanism of a high volume printer, such as the Xerox model 9500, which is shown in dot-dash lines at the left side of the figure.

The high capacity sheet feeder 21 shown in the figures comprises a base frame 22 of elongated rectangular configuration, having at one end a vertical support column 23 underlying and supporting a singulating shingling mechanism 24, which has a counterbalanced sheet infeed tray platform 26 cantilevered outward from the left end of the feeder 21 shown in FIG. 1 to engage the feed mechanism 143 of a high volume host machine 27 such as the Xerox Model 9500 or Model 9700 printer. Sloping diagonally upward from a short end column 28 at the opposite "loading" end of base frame 22 is a slanting loading feed ramp 29 on which as many as thirty reams or 15,000 sheets of paper to be fed to printer 27 can be stacked edgewise in an elongated resupply feed block 31. Column 28 houses resupply feed motor M and the resupply drive and transmission assembly.

Figure 2:
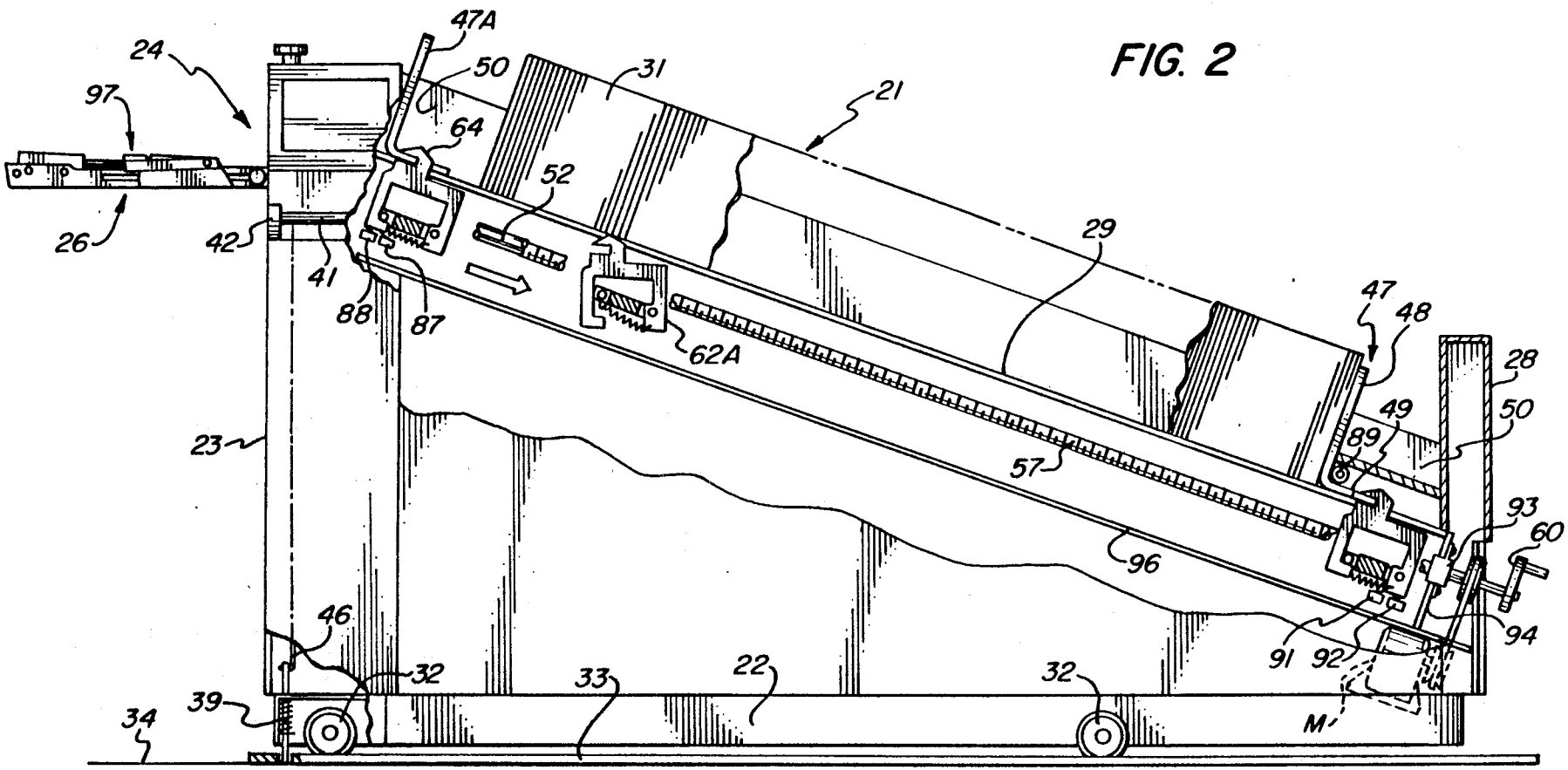
FIG. 2 is a front elevation view of the high capacity sheet feeder of the present invention, partially broken away to show its internal construction.

Support column 23, base frame 22 and end panel 28 form with loading feed ramp 29 a sturdy and stable triangular structure, easily capable of supporting this entire load of thirty reams of paper, extending on the slanting ramp 29 from its low loading end up to its high feed end, or from right to left as viewed in FIGS. 1 and 2. Sheet feeder 21 is supported on rollers 32 engaging a pair of tracks 33 anchored firmly in position on the supporting floor 34 by adhesive 36, which may be double sided adhesive tape, for example, shown in FIG. 5, applied directly to carpet, vinyl or other flooring.

Figure 5:
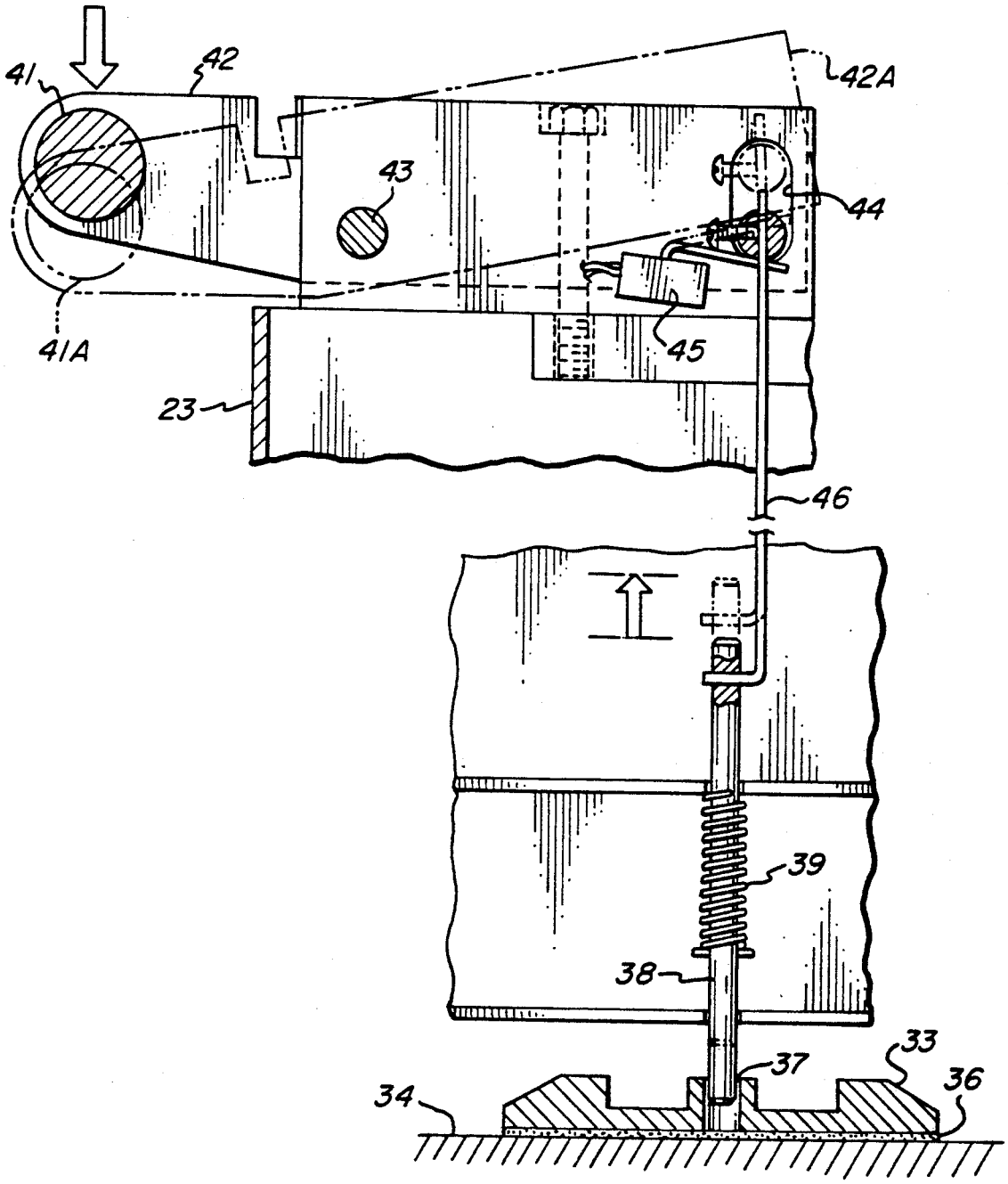
FIG. 5 is a fragmentary cross-sectional diagrammatic end view of the track latch mechanism securing the feeder in its operating position and capable of releasing it for rollaway servicing, maintenance, or normal operation of the host machine, without the high capacity feeder.

As shown in FIG. 5, the front track 33 is provided with a lock aperture 37 in which a vertically withdrawable locking bolt 38 is normally engaged, and held in position by a biasing spring 39 urging the bolt 38 downwardly into the lock aperture 37. The mechanism illustrated in FIG. 5 allows the locking bolt 38 to be withdrawn whenever an unlocking bar 41 is depressed downward to the dot-dash line position 41A shown in FIG. 5.

Unlocking bar 41, best seen in FIGS. 1 and 2, extends lengthwise across the front of column 23 at the user's waist height between two pivot arms 42. As shown in FIG. 5, arms 42 are pivoted in the upper front portion of column 23 on a pivot pin 43, and are thus movable between the solid line position 42 and the dot-dash line position 42A shown in FIG. 5.

In the position 42A, pivot arms 42 raise an anchor block 44 mounted at the rear end of arms 42 and clamped by a set screw to the upper end of an actuator rod 46, whose lower end is anchored to the upper end of locking bolt 38, all as shown in FIG. 5. Downward movement of unlocking bar 41 thus raises actuator rod 46 and bolt 38, depressing a microswitch 45 to switch the feeder's power off, withdrawing the bolt from lock aperture 37 and freeing the entire sheet feeder 21 for rolling movement on rollers 32 along track 33 in a direction away from printer 27 to the right in FIGURE 1. This rolling movement withdraws the singulator shingling mechanism 24 and the counterbalanced sheet infeed platform 26 from printer 27, and allows free access to all sides of printer 27 for normal operation, inspection, maintenance, repairs or the like.

Feed Ramp

Figure 3:
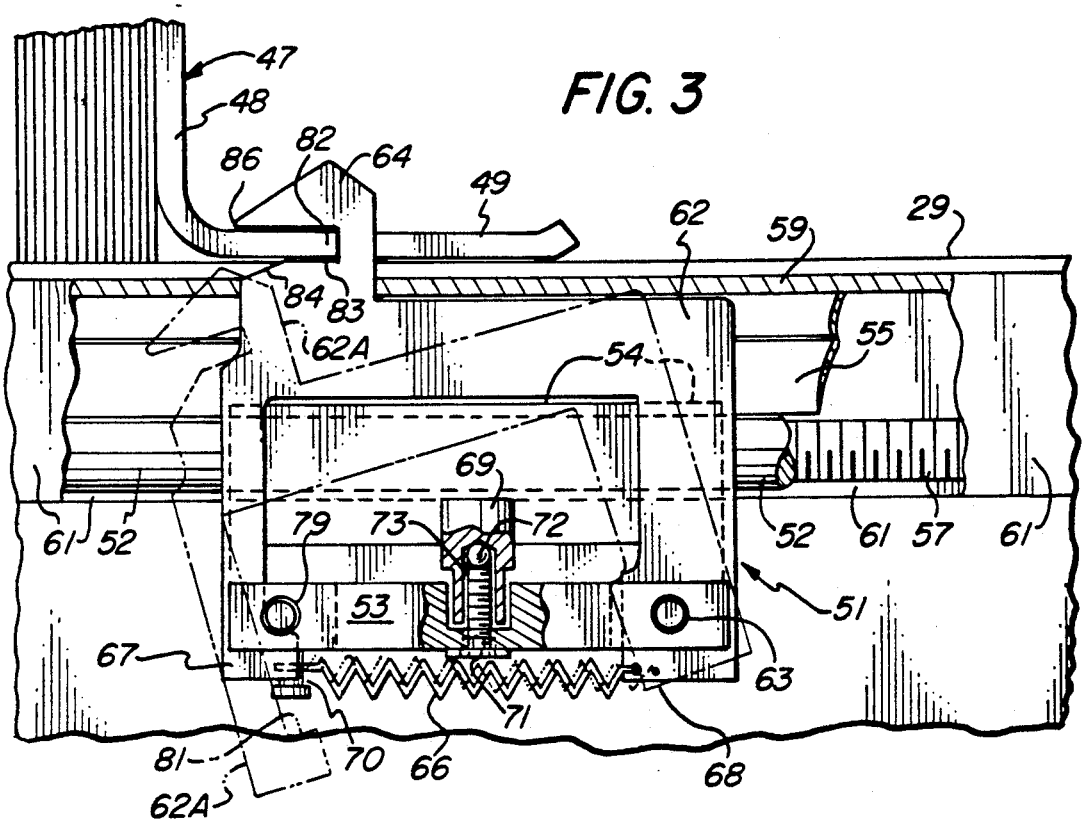
FIG. 3 is a fragmentary enlarged front elevation view of the cooperating components of the feed mechanism of the device.

The diagonally slanting feed ramp 29 is best seen in the broken away side elevation view of FIG. 2, where an elongated block of multiple reams of paper sheets is shown positioned on the diagonal ramp 29. A pusher plate 47 is shown at the right hand side of FIG. 2 and is L-shaped in configuration, with its tallest arm 48 leaning against the lower end of sheet feed block 31 in the manner of a bookend while its shorter arm 49 extends along and rests upon ramp 29. A fragmentary enlarged view of pusher plate 47 is also shown in FIG. 3 and a perspective view of the pusher plate also appears in FIG. 1.

As shown in the figures, a drive carriage 51 is mounted for movement with most of its structure positioned directly beneath loading ramp 29 for sliding engagement with a guide rod 52 suspended along the lower edge of a depending web plate 53 mounted on the underside of ramp 29. As shown in the end elevation view of FIG. 4, carriage 51 incorporates a base 53 underlying a sleeve block 54 incorporating a longitudinal cylindrical sleeve passage 56 slidingly engaging the guide rod 52. Sleeve block 54 is shown bolted to base 53 in FIG. 4, and is indicated in solid and dash lines in FIG. 3. Beside longitudinal guide rod 52 is a longitudinal feed screw 57 also positioned under ramp 29 directly above base 53 of drive carriage 51. The drive carriage is provided with a threaded feed nut 58 bolted to base 53, with threads engaging the mating threads of feed screw 57.

Figure 4:
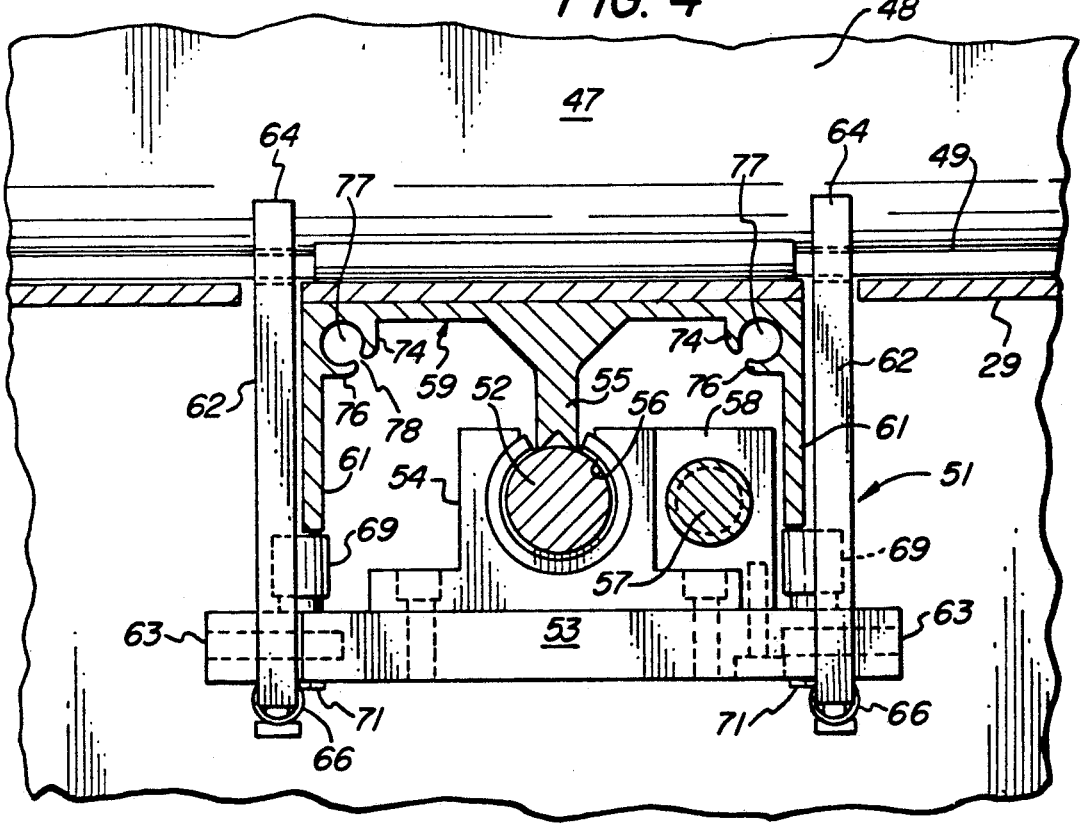
FIG. 4 is a fragmentary cross-sectional end elevation view of the same feed mechanism components.

The guide rod 52 and its supporting web 55 are suspended centrally from the underside of a guide rail channel 59 anchored to the underside of feed ramp 29 and having elongated rectangular downwardly depending rails 61 along its entire length under ramp 29. The lower edges of rails 61 are spaced above the normal position of base 53, as indicated in FIG. 4. A small portion of the nearer rail 61 is shown at the right and left sides of FIG. 3, and the lower edge of the remote opposite rail 61 is shown just beneath feed screw 57 in FIG. 3.

A pair of pivoted hooked side plates 62 are pivotally mounted on base 53 by pivots 63. As indicated in FIGS. 3 and 4, side plates 62 are free to pivot between two working positions, a drive position illustrated in solid lines in FIG. 3, in which upper drive hooks 64 are in position for engagement with the pusher plate 47, and a retracted position 62A shown in dot-dash lines in FIG. 3, in which the drive hooks 64 are lowered to a position 62A again shown in dot-dash lines in FIG. 3. In this retracted position, the drive hooks 64 are beneath pusher plate 47, leaving the entire carriage 51 and its associated drive hooks 64 free for return movement from the upper end of ramp 29, beneath the multiple sheet feed block 31 on the ramp, to a lower position near the lower end of ramp 29, where they may again be engaged with the next pusher plate, ready to drive a new multiple sheet feed block 31 up ramp 29 to follow the previous feed block into feeding position.

Resilient tension coil springs 66 have their ends secured in suitable anchor fittings 70 in the forward end 67 of the carriage base 53, and their rear ends suitably anchored in side plates 62 beneath pivot 63 at the rear end of the side plate, by anchor fittings 68 formed in this lower corner of each pivoted hooked side plate 62. Coil springs 66, being installed under tension, resiliently urge side plates 62 toward their solid line position shown in FIG. 3 with their drive hooks 64 engaging the pusher plate 48. However, when drive screw 57 is rotated in its reverse direction, causing feed nut 58 and the entire carriage 51 connected thereto to traverse back down the sloping structure toward its lower end, hooks 64 are urged downwardly under the feed block 31 of multiple paper sheets, into the dot-dash line position 62A shown in FIG. 3 for the passage back down ramp 29 under the entire feed block 31, with the coil springs 66 being correspondingly stretched during this downward traverse of the carriage 51.

In order to adjust carriage 51 and its side plates 62 for minimum friction on guide rod 52 and feed screw 57, a pair of adjustable rail guides 69 are mounted in the base 53, projecting upward respectively against the depending lower edges of rails 61. The structure of each rail guide 69 is shown in the fragmentary cross-sectional central portion of FIG. 3, where the rail guide is shown to have a flat upper surface engaging the lower edge of rail 61. Each rail guide 69 has a central bore 73, loosely accommodating an adjustment screw 71 with a stainless steel ball 72 at its upper end centering rail guide 69 directly along the axis of the adjustment screw 71 in the conical blind end of the central bore 73 of the rail guide 69. Adjustment screw 71 is threaded into base 53, as indicated in FIG. 3 and the central bore 73 of guide 69 is oversized and not engaged with the threads of adjustment screw 71.

Formed in the upper inside corners of the channel shaped guide rail 59 are flanges 74, depending from the flat central web portion of the guide rail 59, with their edges in close juxtaposition to the edges of inwardly extending flanges 76, protruding inward from the upper portion of each rail 61 and forming enlarged recesses 77, useful as wiring and guide tunnels, accessible through inwardly facing diagonal slots 78 between flanges 74 and 76, through which wiring cables and the like may be inserted during assembly.

Adjustment of the adjustment screws 71 on each side of base 53 to raise the rail guides 69 into sliding contact with the lower edges of the rail 61 assures smooth guiding alignment of carriage 51 along the guide rod 52 and feed screw 57 while minimizing any misalignment forces applied by the hooked side plates 62 engaging pusher plate 47, which might tend to cause binding or excessive friction between the carriage 51 and the guide rod 52 or the feed screw 57. It should be noted that the base 53 of drive carriage 51 is provided at its forward end with a stop pin 79 protruding outward from the lateral edge of base 53 into interfering alignment with a stop ledge 81 formed at the forward lower corner of side plate 62, facing in the direction of pivot pin 63 and positioning the hook 64 at the correct height for engaging the rear flange edge of shorter arm 49 of pusher plate 47, as indicated at the upper portion of FIG. 3. It will be noted in this figure that the driven edge 82 of this shorter arm flange 49 of pusher plate 47 fits into a mating hook slot 83 formed in the hook 64 of side plate 62. Slot 83 has a beveled lower portal lip 84 for sliding entry of the driven edge 82 into the slot 83. The upper lip 86 of hook slot 83 extends forward over the driven edge 82 by an appreciable distance, thereby stabilizing pusher plate 47 in its driving engagement with side plate 62 and preventing the pusher plate from rocking or leaning backward under the load provided by the sheet feed block 31, whose considerable weight would otherwise tend to tilt pusher plate 47 backward over side plate 62.

Paper Sheet Block Loading Operation

As indicated in FIG. 1, pusher plate 47 supplies translation force tending to move the entire sheet feed block 31 up ramp along the ramp 29 from the loading end to the feed end of the ramp closely adjacent to the singulating feed assembly 105 and counterbalanced infeed tray 26. The delivery, singulation and shingling of the individual sheets at the feed end of feed block 31 will be described in detail hereinafter. As sheets are removed from the feed end of the feed block, automatic sensors produce advancing movement of feed screw 57, revolved by a feed screw drive motor M which is preferably positioned in column 28 at the lower end of the feed screw 57 as indicated schematically in FIG. 2.

Advancing feed rotation of the feed screw 57 causes the pusher plate 47 to move upward along diagonal ramp 29, as previously described. When the pusher plate 47 reaches its uppermost position 47A shown at the left side of FIG. 2, all the rest of ramp 29 provides ample room for reloading of a new elongated multiple ream column of sheets forming the feed block 31, aligned against a rear paper guide 50 as indicated in FIG. 2, with a new pusher plate 47 being mounted at the lower right hand end, in position to feed this new block 31 up ramp whenever desired.

Fail Safe Feed Screw Operation

As the last sheets are fed from the previous feed block to the left of pusher plate position 47A, drive plates 62 have reached their upper terminal position. Two sensor switches 87 and 88 are illustrated directly below the pusher plate 47A in the terminal position in FIG. 2, the right hand one of these, switch 87, being a deceleration sensor switch assuring that the feed screw rotation will be reduced to a very slow forward feed as soon as deceleration sensor 87 is actuated by the arrival of drive carriage 51 in contact with its sensor arm, and simultaneously a flashing light is initiated, warning of impending runout of the paper sheet supply. The second or left one of these switches is a stop sensor 88, and the arrival of the drive carriage 51 at the position where it actuates the sensor arm of stop sensor 88 opens the switch therein and cuts off forward feed rotation of feed screw 57, also changing the flashing light to a continuous light indicating the actual out of paper condition.

Thereafter, upon command, the feed screw may be rotated in its reverse direction causing the drive carriage 51 to move down the slanting feed screw, disengaging hooks 64 from the pusher plate at its terminal position 47A. The pusher plate 47A may then be removed and continuing reverse rotation of feed screw 57 merely depresses hook 64 under block 31, as indicated in position 62A shown in solid lines in the central portion of FIG. 2 and in dot-dash lines in FIG. 3, with hooks 64 depressed beneath the upper surface of ramp 29.

At the right hand end of FIG. 2, the new pusher plate 47 is shown standing on ramp 29, with its shorter arm 49 extending underneath a stop bar or stop post 89, and its taller arm 48 standing up ramp from stop post 89 and in abutting engagement therewith. The pusher plate 47 may be placed in this position like a sheet metal bookend while multiple reams of paper are placed edgewise on ramp 29 leaning against pusher plate 47. Successive reams are stacked, progressively arrayed in the up ramp direction, until the entire block 31 is loaded on ramp 29, as indicated in FIG. 2. While the previous singulated and shingled sheets from the previous feed block 31 are being delivered to the counterbalanced infeed tray, this retracting repositioning of the drive carriage 51 can be initiated and often completed in a very short period of time.

When the drive carriage 51 reaches the lowermost position indicated at the right hand end of FIG. 2, two further limit switches are actuated, the deceleration sensor 91 and stop sensor 92, performing functions similar to sensors 87 and 88 at the upper end of ramp 29.

In its lowermost stopped position, shown at the right hand side of FIG. 2, the hooks 64 have cleared the underside of block 31 and pusher plate 47, and the springs 66 have raised side plates 62 above the level of ramp 29 in the down ramp position beyond pusher plate 47 as illustrated in FIG. 2.

Actuation of motor M, located beneath the lower end of ramp 29 in the short end column 28, to produce resupply feed advance rotation of feed screw 57 advances the drive carriage 51 with side plates 62 deploying hooks 64 into engagement with flange 49 of pusher plate 47. As a result, pusher plate 47 is driven slowly up ramp 29 until the uppermost feed end of feed block 31 reaches the position where the first sheets of the feed block are ready for singulation and shingling in the remaining subassemblies of this invention.

At the lower or loading end of the high capacity sheet feeder 21 shown in FIG. 2, the feed screw 57 is shown supported in a bearing 93 mounted on an end wall 94 of the overall assembly, upstanding from a lightweight base panel 96 underlying the feed screw 57 and guide rod 52 along the entire path of travel of drive carriage 51 from the lower loading edge of ramp 29 shown in FIG. 2 to the upper feed end of the ramp at the upper left hand end of FIGURE 2. The bearing 93 mounted on end wall 94 is mounted in a sacrificial bearing mount, a lightweight sheet metal centering cup, designed to hold feed screw 57 in its desired position during all normal operations with normal feed loads. If any unusual friction or jamming interference of parts produces endwise translation of feed screw 57, this sacrificial cup bearing mount for bearing 93 automatically inverts and breaks loose from end wall 94, avoiding any damage to the more valuable machined parts such as the feed screw, the drive carriage 51 and its related subassemblies, the side plates, the pusher plate 47 or any of the sensors 87, 88, 91 and 92. Any such unusual friction or interference occurring at the upper end of the travel of carriage 51 along feed screw 57 near the upper feed end of ramp 29 will produce the same result, with breakaway protection for the valuable component parts of the device. When repairs or adjustments are completed, a new sacrificial bearing mount securing bearing 93 in end wall 94 allows the entire assembly to be reassembled and restored to operation readily.

Feed Mechanism for Individual Sheets

Figure 6:
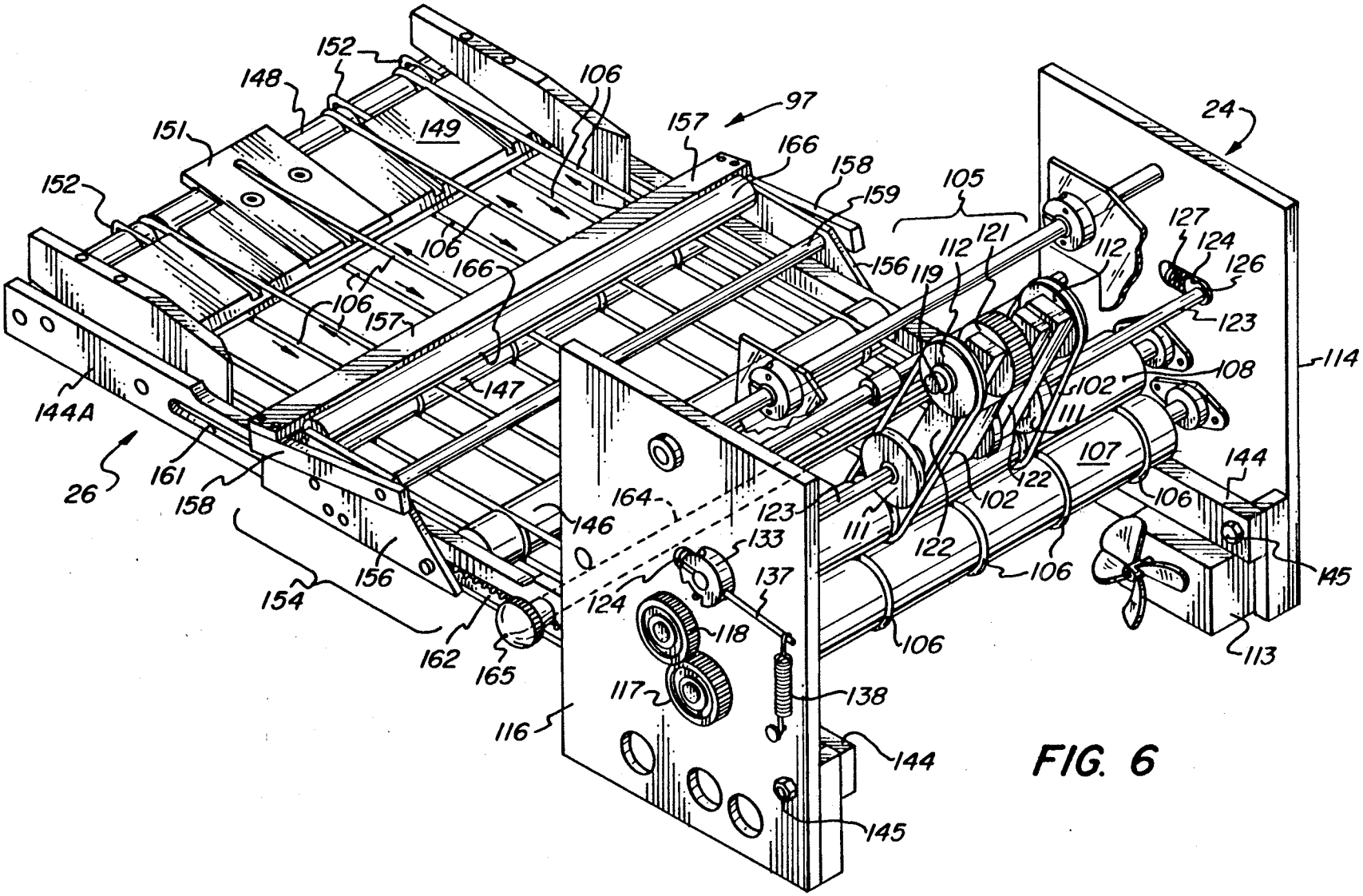
FIG. 6 is a perspective view of the singulating shingling mechanism of the device for delivering fresh sheets to the underside of the sheet stack on the counterbalanced infeed tray platform of the feeder.
Figure 7:
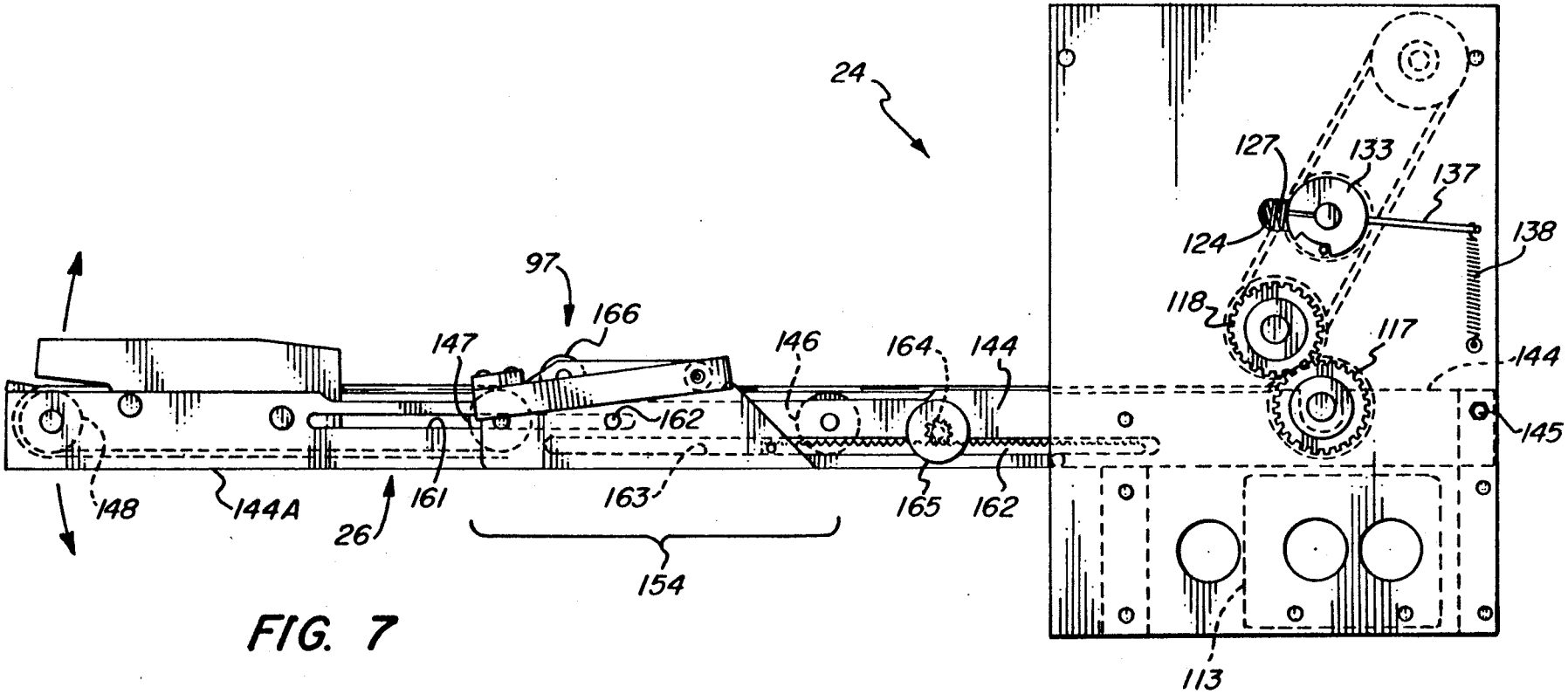
FIG. 7 is a front elevation view of the same singulating shingling mechanism.

The singulator shingling mechanism 24, the counterbalanced infeed tray 26 and the sheet stream feeder 97 are shown in the fragmentary perspective view of FIGURE 6, and they are also seen in the upper central portion of FIG. 1 between the sheet feed block 31 and the printer 27. In addition, the side view of FIG. 7 shows the side elevation of these subassemblies in their cooperating relationship.

Singulating Feed Assembly

As the frontmost sheet 104 of the feed block 31 arrives at the upper end of ramp 29, it is thus delivered into abutting contact with a singulating feed assembly 105 shown in FIG. 6 and in more detail in FIGS. 7, 8, 9 and 11–13. This feed assembly drives the singulating belts 102 to strip each frontmost sheet 104 in turn from feed block 31 and drive it downward into the sheet stream feeder 97. In addition, the singulating feed assembly 105 is articulated, and provided with two limit switches governing the feed screw operation to advance the feed block 31 into its feed position, and alternatively to cut off feed and shut down the entire device as an emergency stop condition if the feed block 31 is moved too close to the singulating feed assembly creating a risk of jamming. Removal of a few sheets from the frontmost portion of feed block 31 then reinitiates normal feed operation.

Figure 10A:
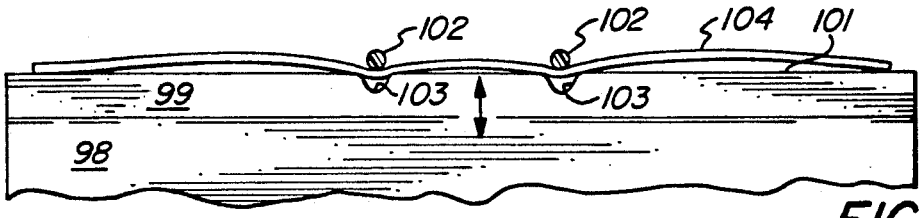
FIGS. 10A and 10B are fragmentary cross-sectional views taken along the planes 10A—10A and 10B—10B in FIG. 9, both substantially perpendicular to the advancing sheets as they are singulated by the device.

The block of sheets 31 delivered up ramp 29 to the singulating feed assembly 105 arrives on a delivery deck 98 having a downward slanting deck ramp 99 ending at a terminal deck edge 101 closely adjacent to a pair of round polymeric singulating belts 102. Smooth rounded notches 103 are formed in deck edge 101 to accommodate singulating belts 102, and the deck 98 is adjustable over a short range of motion toward and away from belts 102 to vary the space between the singulating belts 102 and the depth of notches 103. Slight intrusion of singulating belts 102 into the notches 103 has the effect of causing an arching or buckling shape of the frontmost paper sheet 104 in direct contact with the singulating belts 102, as shown in FIG. 10A and this frontmost sheet 104 is thus slightly arched, with a central arched portion spaced very slightly away from deck edge 101, and also with outer arched portions spaced slightly away from deck edge 101, with the singulating belts 102 depressing two tractive portions of frontmost sheet 104 into the mouth of the respective notches 103 in the deck ramp 99.

Figure 10B:
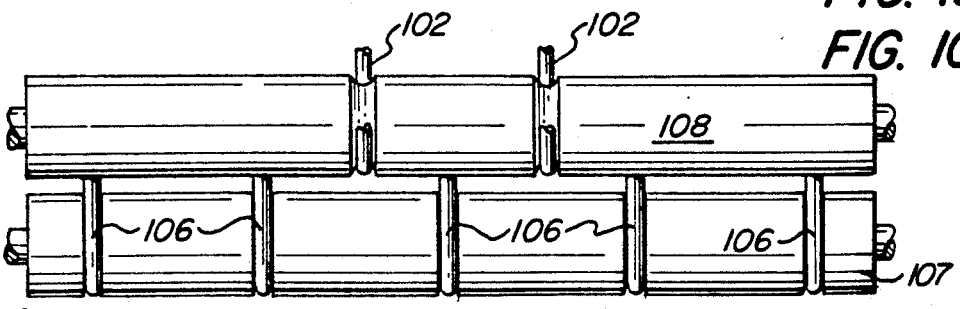

This arching or buckling configuration of frontmost sheet 104 assures that any fibre-lock adhesion between frontmost sheet 104 and the following flat sheets directly behind it will be broken by the presence of air molocules between these sheets, assuring the effective singulation of each frontmost sheet in turn as it is contacted by singulating belts 102 and driven downward toward feed belts 106 passing around a nip roller 107 directly beneath delivery deck 98 and deck ramp 99. As indicated in FIG. 10B, a plurality of five feed belts 106 are employed to receive and advance each frontmost sheet 104 in turn as it descends downward between feed block 31 and singulating belts 102. Singulating belts 102 are preferably circular in cross section and may be termed "O-belts", and feed belts 106 may likewise be "O-belts" as illustrated in the figures.

Singulating belts 102 are positioned encircling a guide roller 108 closely adjacent to nip roller 107 and extending laterally across the entire width of the sheets in feed block 31. Suitable guide grooves formed in guide roller 108 accommodate these singulating belts 102 and the guide grooves 109 are deep enough to receive the entire diameter of belts 102 and actually allow the belts travelling around guide roller 108 to be recessed beneath the roller's periphery as indicated in the figures, assuring that each frontmost sheet 104 in turn will travel around guide roller 108 without wrinkling. Thus, as indicated in FIG. 9, the sheet 104 is gripped between the plurality of feed belts 106 and the periphery of guide roller 108 as it passes between the two rollers 107 and 108.

Figure 9:
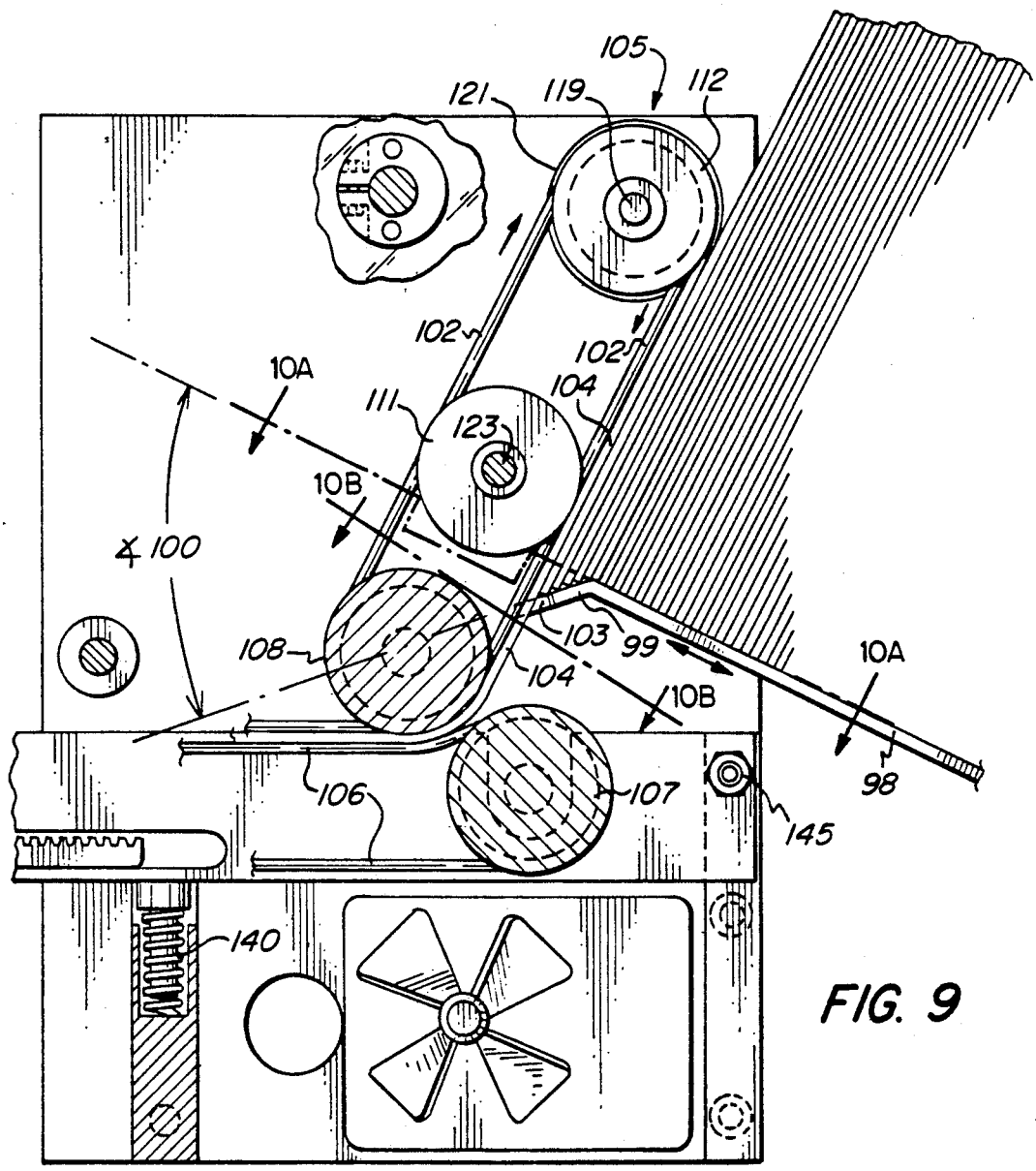
FIG. 9 is a fragmentary cross sectional front elevation view of the same mechanism receiving individual sheets delivered by the high capacity sheet feeder, showing the singulating operation of the device.

As indicated in FIG. 9, the two singulating belts 102 travel in a clockwise direction around roller 108 and they each pass an intermediate idler sheave 111 as they travel upward to encircle an upper pressure sheave 112. The two pressure sheaves 112 and a slightly oversize central feed roller 121 are all mounted on a stud shaft 119 at the top of singulating feed assembly 105. The arriving feed block 31 of stacked paper sheets delivers frontmost sheet 104 into direct contact with feed roller 121 and belts 102 on pressure sheaves 112, as clearly illustrated in FIG. 9.

In the perspective view of FIG. 6, the full width rollers 107 and 108 may be compared to the idler sheaves 111 and pressure sheaves 112 which are merely wide enough in an axial direction to receive and guide the singulating belts 102. Also clearly shown in FIG. 6 and 7 are the mating gears drivingly joining the nip roller 107 and the guide roller 108 for pinch roll type engagement at matched angular speeds. Driving torque for these rollers 107 and 108 is supplied by a feed drive motor 113 positioned beneath nip roller 107 and mounted on the inner face of a rear pedestal plate 114 on which are mounted the bearings supporting the shafts of rollers 107 and 108 as shown in FIG. 6. A timing belt drive 115 connects the shaft of motor 113 to the shaft of nip roller 107.

A front pedestal plate 116 supports corresponding shaft bearings for rollers 107 and 108 and the short lengths of the roller's shafts extending beyond the outer face of front pedestal plate 116 provide keyed mountings for the drive gears 117 and 118 drivingly joining the rollers 107 and 108 together for matched angular velocity.

A stud shaft 119 provides the rotational mounting for the upper pressure sheaves 112 and the slightly oversized feed roller 121, formed of a soft tractive polymer material, whose diameter is slightly greater than the diameter of singulator belts 102 as they pass around their respective upper pressure sheaves 112. Thus, as indicated in the figures, the feed roller 121 comes in contact first with the frontmost sheet 104 being delivered on the delivery deck 98, just before this sheet 104 reaches singulator belts 102.

Stud shaft 119 is journalled in a pair of upstanding yoke arms 122 whose opposite lower ends are pivoted on a transverse pivot shaft 123 extending across the entire width of the singulator shingling mechanism 24, and both ends of the pivot shaft 123 are resiliently mounted for horizontal movement in mounting slots 124 accommodating sliding bearing blocks 126 in which the pivot shaft 123 are mounted. As indicated in the drawings, compression coil springs 127 positioned in the mounting slots 124 resiliently urge bearing blocks 126 toward the feed block 31 as indicated in detail in FIG. 8.

The diagonal upstanding position of yoke arms 122 is thus determined by the resilient positioning of shaft 123. This positioning presents singulating belts 102 in the position required for singulating and feeding frontmost pages 104 into the nip between rollers 107 and 108, and at the same time the mechanism mounted on resiliently biased shaft 123 performs a number of control functions governing the operation of the entire assembly.

Figures 11, 12, 13:
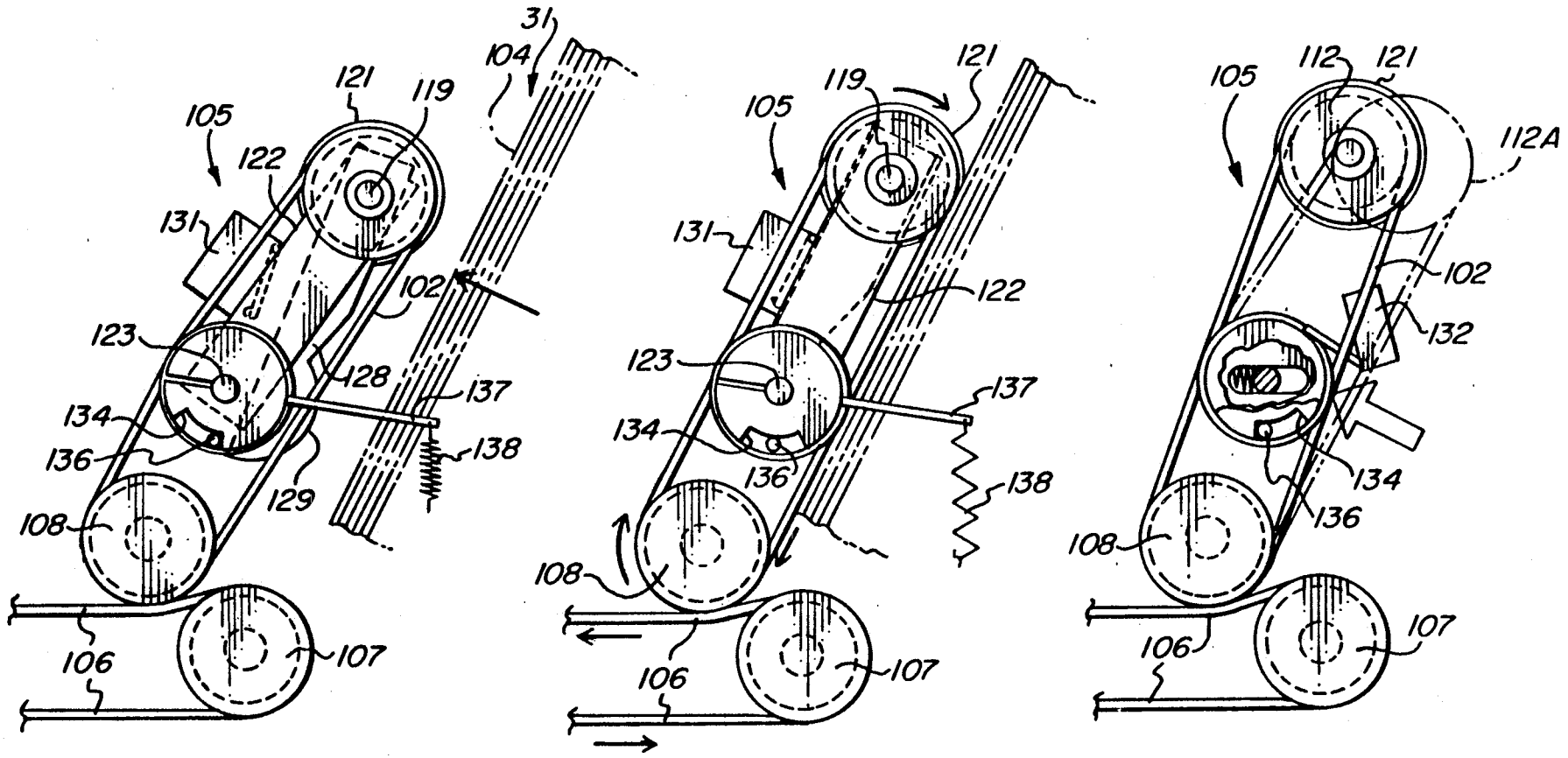
FIGS. 11, 12 and 13 are fragmentary schematic cross sectional front elevation views of the feeder belt drive mechanism showing the operation of two different limit switches designed to actuate the drive and to deactivate the feed advance before overfeeding has occurred.

The two yoke arms 122 are preferably rectangular in shape, and are keyed at their lower ends to pivot shaft 123, and a stud shaft bore at their upper ends in which stud shaft 119 is journalled. The rectangular shape of these yoke arms 122 is shown in FIGS. 11 and 12 and also indicated in FIG. 6.

Automatic Ramp Feed Control

Pivotally mounted on stud shaft 119 and depending therefrom on the feed block 31 side of pivot shaft 123 is a feed start finger 128. At any time the sheet feed block 31 is not in position with its frontmost sheets abutting the feed roller 121, feed start finger 128 depends downward and forward toward the feed block with a sensing surface 129 positioned to provide the second contact of the singulating feed assembly 105 with the advancing feed block 31, immediately after first contact with feed roller 121. This is indicated in FIG. 11, where frontmost sheet 104 is shown approaching feed roller 121 and sensing surface 129 of feed start finger 128 depending downward from stud shaft 119. Feed advance of the block 31 continues until feed start finger 128 has been depressed clockwise about stud shaft 119 to the position shown in FIG. 12, where surface 129 has now withdrawn into alignment with singulating belts 102 and feed roller 121 carried by yoke arms 122 pivoting with shaft 123 on bearing blocks 126 and a resupply feed advance switch 131 mounted on an arm 122 has had its actuating arm depressed by this counterclockwise movement of start finger 128 to close the switch 131 and terminate resupply feed advance motion of the feed block 31, as shown in FIG. 12 as compared with FIG. 11.

In this position, with frontmost sheet 104 in contact with feed roller 121 and singulating belts 102, normal feed can progress and the frontmost sheets can be fed sequentially into the sheet stream feeder 97. A ratcheting resupply mechanism for incremental feed advance of feed block 31 is provided by a resupply sensor switch 131 mounted on yoke arm 122, with its actuator arm free for movement toward feed block 31 and away from sheet stream feeder 97. Each end of shaft 123 has keyed thereon an aligned switch actuator cam 133 having a sector cutout 134, subtending approximately 80 degrees along its lower edge beneath shaft 123, engaging a stationary pin 136 protruding from the adjacent face of the pedestal plate 114 or 116 into engagement with the sector cutout 134. Each cam 133 has a spring arm 137 extending radially therefrom biased downwardly by a tension spring 138 whose lower end is anchored to the adjacent pedestal plate.

Figure 8:
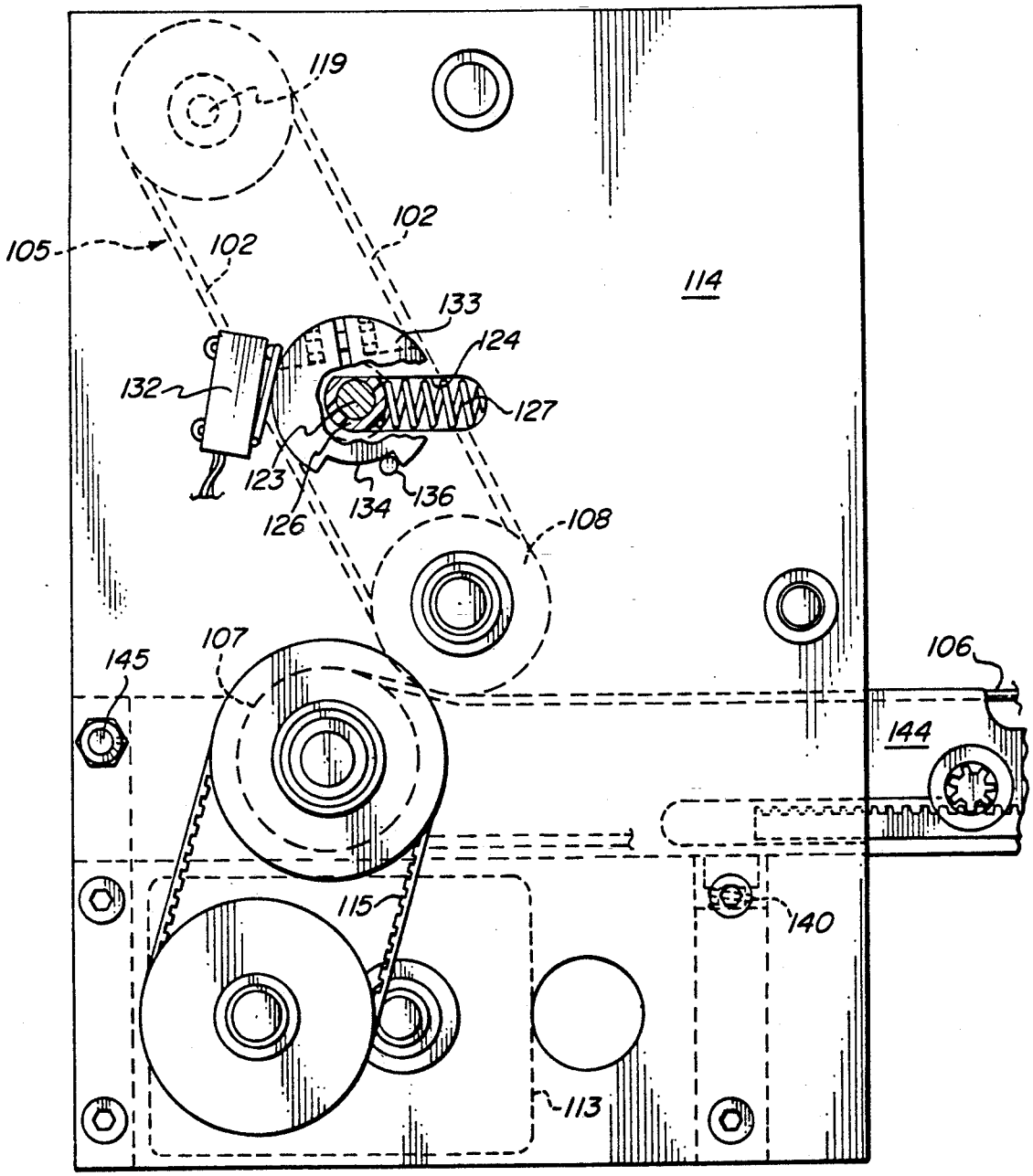
FIG. 8 is a fragmentary greatly enlarged rear elevation view of the same singulating shingling mechanism.

A comparison of FIGS. 8, 11, 12 and 13 shows that in the feed advance mode of FIG. 11 up to the point where normal feed operation begins in FIG. 12, the resupply sensor switch 131 is unactuated to assure normal feed screw resupply operation. As can be seen by comparing the positions of spring arm 137 and spring 138 in FIGS. 11 and 12, the feed roller 121 is in constant pivotal "tension" with foremost sheet 104 of the feed block 131. If the feed advance of feed block 31 were to continue, the advancing feed block 31 would move singulating feed assembly 105 toward the printer 27 and away from the ramp 29, as shown in FIG. 12. As this motion begins, cam 133 has the forward end of its sector slot 134 engaging pin 136 as shown in FIGS. 8 and 13.

As such feed continues to advance, causing shaft 123 journalled in sliding bearing blocks 126 to be displaced in slot 124, each cam 133 is pivoted about pin 136 and each spring 127 is depressed, causing shaft 123 to pivot further and moving the spring arm 137 protruding forwardly from cam 133 to rotate upward even further, stretching tension spring 138 secured between the outer end of spring arm 137 and the pedestal plate beside it as indicated in FIGS. 6, 7, 11 and 12.

Spring 138 is shown drawing spring arm 137 downward in FIG. 7 in the position it occupies as feed block 31 first comes in contact with feed roller 121 of singulating feed mechanism 105. As feed block 31 advances and spring arm 137 is raised to the position shown in FIGURE 12, stretching spring 138, the cam 133 pivots on its keyed shaft 123 to the position shown in FIG. 12.

Further advance of feed block 31 causes the entire singulating feed assembly 105 to move counterclockwise to the position shown in FIG. 13, and resupply safety stop switch 132 is opened by the withdrawal of cam 133 from the switch's actuator arm, as indicated in FIG. 13 stopping supply motor M located within column 28 and preventing damage to the system. Manual removal of a sufficient number of frontmost sheets 104 from feed block 31, or manual reversing torque applied to a crank 60 extending from the lower end of feed screw 57 (FIG. 2), causes singulating feed assembly 105 to swing back clockwise under the influence of springs 127 and 138 from the position of FIGURE 13 to the normal feed positions indicated in FIGS. 8 and 12, closing switch 132 and again permitting free oscillation of assembly 105 and shaft 123, and initiating resupply feed advance of block 31. This intermittent operation of feed advance via feed screw 57, controlled by switch 131, start finger 128 and constant pressure of feed roller 121 controlled by spring 138, assures an ample supply of frontmost sheets 104 for substantially continuous operation of the entire feed device.

The sensor switch 132 serves as a safety stop switch: if feed screw 57 delivers feed block 31 in the feed advance direction to the point where an excess supply of paper sheets is in position, the automatic pivoting angular movement of singulating feed assembly 105 shuts down the motor M housed within column 28, stopping feed screw 57 until any such oversupply movement is corrected.

In addition to this articulating feed control movement of singulating feed assembly 105, it should be noted that an additional adjustment of the sheet feeding operation is provided by the adjustable positioning of deck ramp 99 toward and away from the singulating feed assembly. This adjustable movement of the deck brings deck edge 101 closer to or farther away from singulating belts 102 and feed roller 121.

Thus, the notches 103 straddle the singulating belts 102 to greater or lesser degree. Since the tension of the belts 102 is constant and the distance between tangent contact of guide roller 108 and idler sheave 111 is also constant, the frontmost sheet 104 being urged downward by feed roller 12 has to exert greater force to displace singulator belts 102 from their notches 103 to permit sheet 104 to pass through. The force required is directly proportional to the tension in the singulator belts 102 and their engagement in notches 103, and inversely proportional to the distance between roller 108 and sheaves 111, and also to the angle 100 between the deck ramp 99 and deck 98, which angle may be adjusted or varied to suit particular applications.

The slightly greater diameter of roller 121, as compared with the diameter of upper pressure sheaves 112, provides a slightly greater linear velocity of the rim of roller 121 as it urges frontmost sheet 104 downward, enhancing the buckling or arching of sheet 104 as illustrated in FIG. 10A and assuring that the fibre-lock bond between frontmost sheet 104 and the sheet directly behind it will be effectively broken during the singulating operation. Deck adjustment allows fine tuning of the effect of this velocity difference for optimum singulating operation.

Sheet Stream Feeder Mechanism

Figure 14:
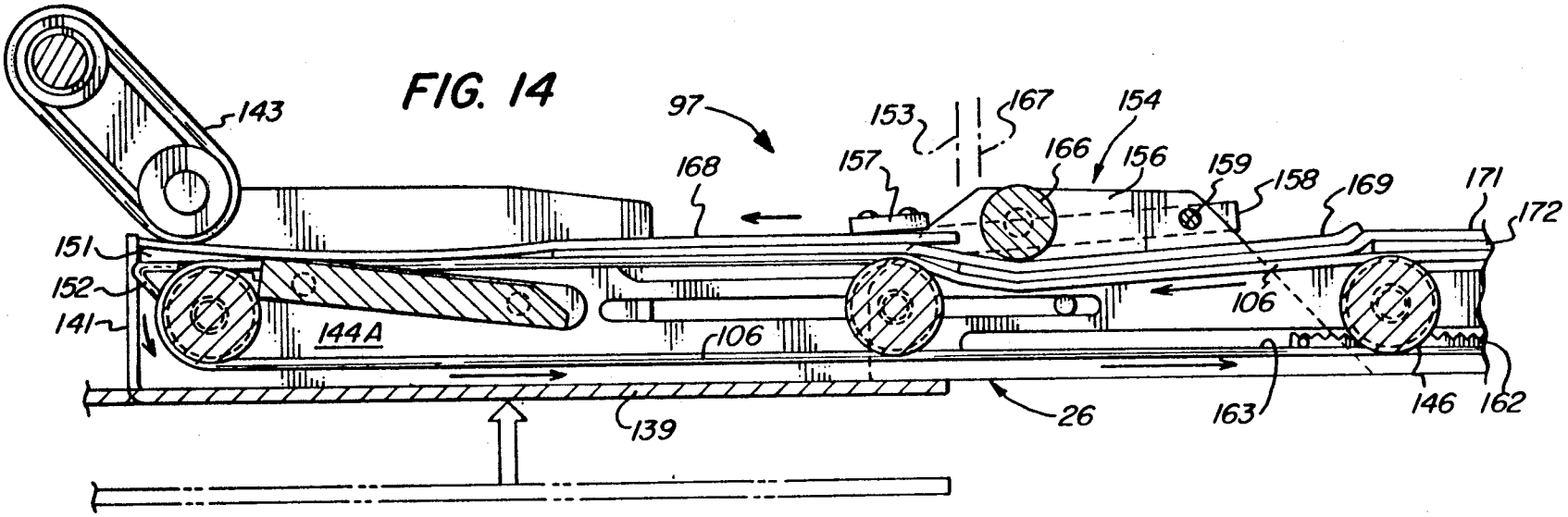
FIG. 14 is a fragmentary front elevation view of the delivery portion of the singulating shingling mechanism delivering fresh sheets to the underside of the sheet stack on the counterbalanced infeed tray platform of the feeder.

The sheet stream feeder mechanism 97 indicated in FIGS. 1, 2, 6 and 7 forms the output or delivery end of the high capacity sheet feeders of the present invention. This sheet stream feeder is designed for cooperation with and is supported on the counterbalanced infeed platform 26 of the high capacity feeders, as illustrated in FIG. 1. Illustrated schematically in FIG. 14 is an elevator tray 139 of machine 27 for holding a plurality of sheets of paper, provided with a feed stop 141. The sheet stream feeder 97 of the present invention constitutes a customized conveyor for delivering new paper sheets in a shingled stream which are added to the underside of a feed stack 142 of sheets presented for intake feed to the high volume printer 27 of FIG. 1.

Figure 15:
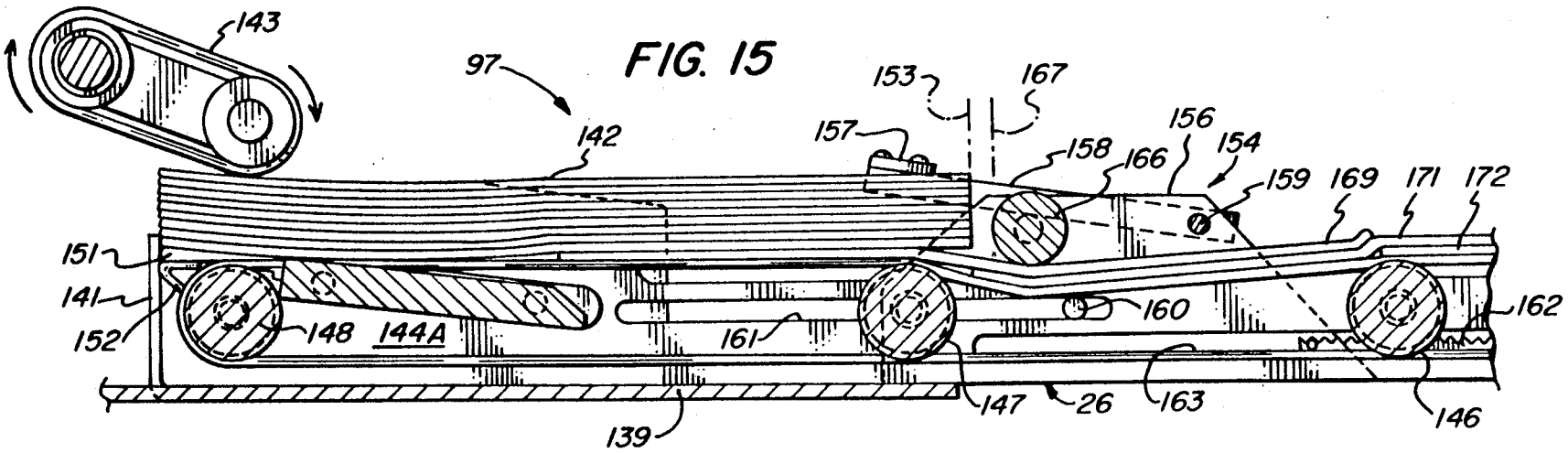
FIG. 15 is a corresponding fragmentary front elevation view of the same mechanism after a suitable stack of sheets has been fed to the underside of the same sheet stack.

Printer 27 is provided with printer feed belt means 143 shown in FIGS. 14 and 15 positioned to engage tractively and draw into the printer 27 in rapid succession the uppermost sheets from stack 142 on feed tray 139. Sheet stream feeder 97 is mounted on counterbalanced platform 26, constructed between a pair of cantilevered arms 144 whose proximal ends are pivoted about pivots 145 at the inside lower portions of the pedestal plates 114 and 116, near ramp 29, as indicated in FIG. 6. The distal ends 144A of arms 144 protrude lengthwise toward the left in FIG. 6 for resting engagement directly on elevator tray 139, as indicated in FIGS. 14 and 15, with their outermost ends contacting stop 141. Counterbalancing compression coil springs 140 support the weight of arms 144, being compressed between arms 144 and the lower portions of the pedestal plates 114 and 116, toward distal ends 144A.

First, second and third feedbelt rollers 146, 147 and 148 are all idler rollers, journalled for rotation in the cantilever arms 144, with their spaced grooves receiving the feedbelts 106 which are tractively driven by nip roller 107, rotated by timing belt 115 driven by motor 113 as shown in FIG. 8. Thus the feed belts 106 pass over the motor driven nip roller 107, beneath guide roller 108. In FIGURES 6 and 7, the driving nip roller 107 and the three feed belt rollers 146, 147 and 148 are shown arrayed from right to left, extending from the singulator feed assembly 105 to the distal end of the sheet stream feeder 97, with five endless feed belts 106 shown travelling around all of these rollers and back for a complete circuit forming a conveyor belt for the stream of singulated paper sheets being delivered to printer 27.

A sheet support plate 149 spans the distal end of the assembly between the two cantilever arms 144A, slanting gently upward with grooves accommodating belts 106 to provide a final support surface at the terminal end of the feed path on which the arriving sheets rest. A protruding central support ledge 151 spans the central portion of this plate 149 and the central feed belt 106 passes through a slot in ledge 151 and hence downward around the third feedbelt roller 148, leaving each sheet delivered by the belts 106 in turn resting upon support plate 149 and its support ledge 151.

Flanking the central support ledge 151 are several stripper fingers 152 extending forward beyond third feedbelt roller 148 and assuring that arriving sheets will not be wrapped around the feedbelt roller 148 and carried under it back toward the feed assembly on the underside of the sheet stream feeder 97. Stripper fingers 152 and support ledge 151 thus present the leading edges of all of the sheets in feed stack 142 with a slight upward slant, as indicated in FIG. 15, and this promotes the smooth even operation of printer feedbelts 143 in drawing each uppermost sheet in turn from stack 142.

Singulated Shingled Sheet Stream Feed Control

As stack 142 is built up by the delivery of fresh sheets to its underside, as indicated in FIGS. 14 and 15, the leading edges of the stack are determined by stop 141 and the trailing edges of the sheets in the stack are all aligned along a vertical rear edge plane 153. Counterbalanced platform 26 supporting the sheet stream feeder 97 is a two-part structure, with a central sliding carriage 154 supporting second feedbelt roller 147 at a selected one of a variety of adjustable positions between rollers 146 and 148 This carriage 154 is shown in FIGURES 6, 7, 14 and 15, where it will be seen that carriage walls 156 flanking the cantilever arms 144 are joined to each other by the roller 147, whose ends are journalled respectively in each of the two carriage walls 156, and also by a feedbar assembly. This comprises a level sensor bar 157 spanning the entire width of feeder 97 above second feedbelt roller 147, and pivotally mounted on pivot arms 158, positioned outside walls 156. Arms 158 are joined to each other by a transverse shaft 159 whose ends extend through journal mountings in plates 156 to be keyed to pivot arms 158. Bar 157 and arms 158 thus form a pivoting structure, which allows level sensor bar 157 to swing up and down about the axis of transverse shaft 159, and to rest on the uppermost sheet of stack 142 near the trailing edges of the stack close to rear edge plane 153, as indicated in FIGS. 14 and 15.

Sliding lengthwise adjustment movement of carriage 154 is guided by the shaft of the second feedbelt roller 147 slidingly mounted in a longitudinal slot 161 in the cantilever arms 144, as well as by a guide pin 160 protruding inward into the same slot 161 from a central part of the inner face of each carriage wall 156. As shown in FIGS. 6 and 7, an adjustment rack 162 pinned to each of the carriage walls 156 extends rearwardly toward the ramp 29, sliding in a longitudinal slot 163 formed in the cantilever arm 144.

Each rack 162 in its slot 163 is engaged with an adjustment pinion 164, keyed to a pinion shaft 166 extending transversly across the structure between the two rack slots 163, and at least one end of shaft 166 has a manual adjustment knob 165 mounted thereon for operator adjustment of the pinion 164 to drive the rack 162 and the associated sliding carriage 154 toward or away from the end stop 141 at the remote end of the cantilever arms 144A.

Adjustment of the knob and carriage 154 positions level sensor 157 directly over the trailing edge of the sheets in stack 142 and also brings into position a biasing roller 166, journalled spanning the carriage 154 between its two upstanding walls 156, spaced a few millimeters rearwardly from rear edge plate 153, to allow the surface of biasing roller 166 which is closest to rear edge plane 153 to define a biasing plane 167 as indicated in FIGS. 14 and 15. The cross sectional side elevation views of FIGURES 14 and 15 clearly illustrate the operation of biasing roller 166 in depressing the stream of sheets travelling lengthwise from right to left, carried by the feedbelts 106, as they approach the second feed belt roller 147. The trailing edge of the stack 142 stands above the arriving sheets and slightly overhangs roller 147, which is adjusted by operation of the adjustment knob 165 to assure that roller 147 is slightly forward of the rear edge plane 153, leaving the overhang illustrated in FIGS. 14 and 15 under which the leading edge of each arriving sheet is delivered by belts 106.

In FIGS. 14 and 15 the shingled stream of arriving sheets are shown with their curvatures exaggerated to emphasize their respective relationship with each other. Thus, in FIG. 14, the first sheet 168 has already been delivered to begin the stack 142 with its leading edge against stop 141 resting on stripper fingers 152 and support ledge 151.

The singulating feed assembly 105 and particularly the relationship of singulating belts 102 and feed roller 121 with deck 98 and deck ramp 99 assure that each new foremost sheet 104 will start its downward travel toward the nip roller 107 before the previous sheet has completed its approach to the nip between the nip roller 107 and guide roller 108.

Thus, a stream of singulated but shingled frontmost sheets 104 is delivered to belts 106, and this shingled stream of sheets is shown in FIG. 14 arriving at biasing roller 166 and sliding beneath the trailing edge of the previous sheet 168. Second sheet 169 is thus shown to be halfway along the underside of sheet 168, and the following sheet 171 is also partially underlying the trailing edge of sheet 169, with the next following sheet 172 similarly extending under the trailing edge of sheet 171.

A later series of sheets 169, 171, 172 are shown in FIG. 15, all being delivered successively to the underside of stack 142 and carried by feedbelts 106 to the stop 141, where they are stripped from the belts and raised by the next following sheet as the stack grows in height from the initial sheet shown in FIG. 14 to the stack of sheets 142 shown in FIGURE 15, from which feed printer feed belts 143 successively draw the topmost sheet into the printer 27.

The counterbalanced tray 26 remains stationary from the moment elevator tray 139 raised it originally to bring stack 142 into contact with the printer's feed mechanism 143.

Figure 16:
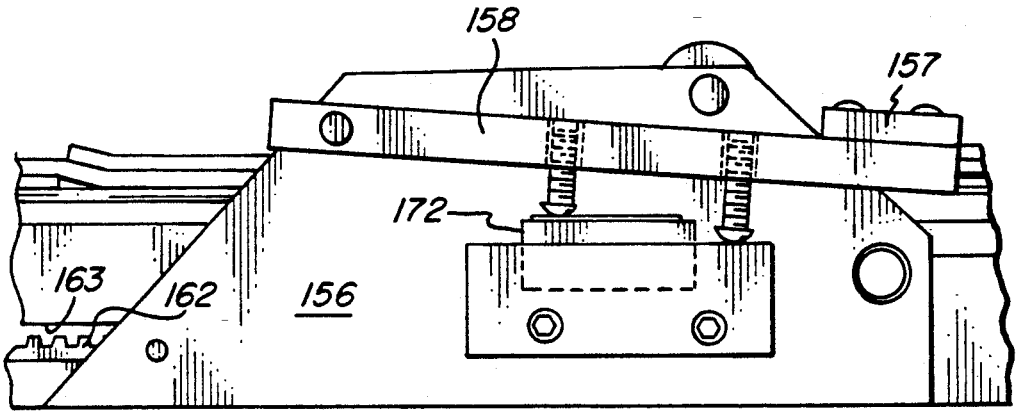
FIGS. 16 and 17 are enlarged fragmentary rear elevation views showing the full stack bar limit switch operation, deactivating the delivery of infeed sheets until the infeed stack has been reduced by normal printer operation.
Figure 17:
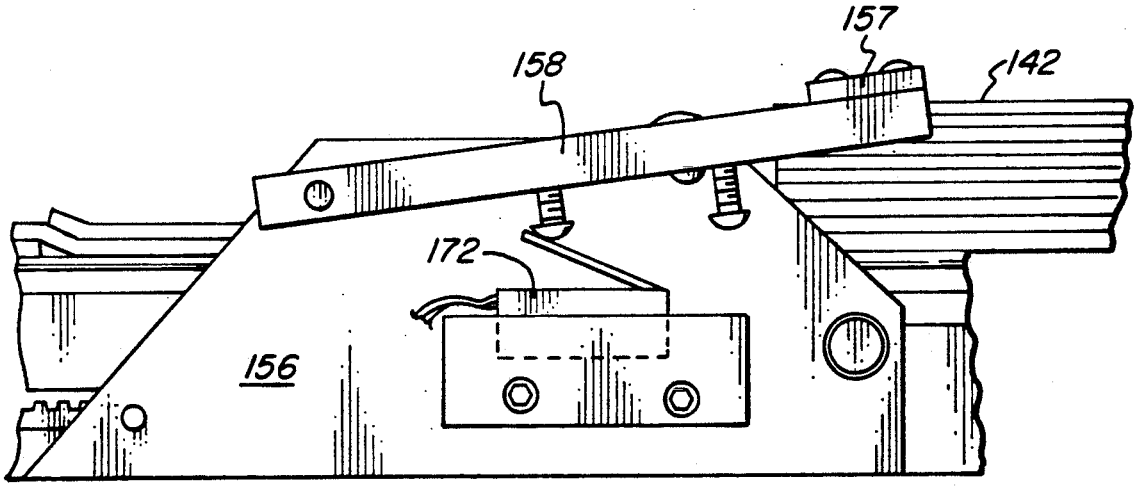

As stack 142 rises, level sensor bar 157 is displaced upward, and when the stack reaches the desired height, as indicated in FIG. 17 as compared with FIGURE 16, the resulting angular upward movement of pivot arm 158 beside the rear carriage wall 156 allows a feed sensor switch 172 to open, stopping motor 113 and interrupting the operation of singulating belts 102 and feed belts 106 until the printer has drawn stack 142 down to a point where arm 158 again closes feed switch 172, resuming normal feed operation of the device.

Manual adjustment of the adjustment knob 165 indexing rack 162 along its slot 163 allows the sheet feeders of this invention to accommodate sheets of any required length, such as 11 inch, 13 inch, 14 inch or any other desired length of paper sheets.

It will thus be seen that the objects set forth above, and those made apparent from the preceding description, are efficiently attained and, since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A high capacity self-contained multi-ream paper sheet feeder, for use in conjunction with a high speed printing machine, a copier or the like having an elevator platform for supporting a stack of paper sheets, comprising:

a floor-mounted elongated track extending from adjacent said elevator platform toward a nearby non-adjacent position, a feeder frame movably mounted for translation movement along said track between a feed position adjacent to said elevator platform and a retracted position, a singulator support column mounted on said frame a singulator shingling mechanism mounted on said support column and having a sheet stream feeder extending therefrom above and in juxtaposition with the elevator platform, a feed ramp mounted on said frame having a delivery end adjacent to said singulator shingling mechanism, a pusher plate slidingly mounted on said feed ramp having an upstanding face positioned to engage the outermost sheet of a feed block of paper sheets stacked edgewise on the feed ramp, feed screw means operatively associated with the ramp and positioned to engage and drive the pusher plate along the ramp toward the singulated shingling mechanism, reversible drive means to rotate the feed screw means, and ramp feed control means to govern the actuation and reversal of the reversible drive means.

2. The paper sheet feeder defined in claim 1, further including a lock positioning the movable feeder frame in its feed position, said lock being disengageable to allow the feeder frame to move along the track to its retractable position.

3. A high capacity multi-ream paper sheet feeder, for use in conjunction with a high speed printing machine, a copier or the like having an elevator platform for supporting a stack of paper sheets, comprising:

a feeder frame at a feed position adjacent to said elevator platform, a singulator support column mounted on said frame, a singulator shingling mechanism mounted on said support column and having a sheet stream feeder extending therefrom above an infeed tray platform in juxtaposition with the elevator platform, a feed ramp mounted on said frame having a delivery end adjacent to said singulator shingling mechanism, a detachable pusher plate slidingly mounted on said feed ramp having an upstanding face positioned to engage the outermost sheet of a feed block of paper sheets stacked edgewise on the feed ramp, a rotatable resupply feed screw operatively associated with the feed ramp and connected to engage and drive the pusher plate advancingly along the ramp toward the singulator shingling mechanism, reversible drive means to rotate the resupply feed screw, and ramp feed control means to govern the actuation and reversal of the reversible drive means.

4. The paper sheet feeder defined in claim 3, wherein the feed screw is threadedly engaged with a feed nut removably engageable with the pusher plate upon forward feed screw rotation and automatically disengageable upon reverse feed screw rotation, whereby a forwardly advanced pusher plate can be removed from the feed ramp and replaced at a less advanced position on the feed ramp.

5. The paper sheet feeder defined in claim 4 wherein the disengageable feed nut engages the pusher plate by depressable pivoted drive plates, automatically disengaged and depressed below the feed ramp by reverse rotation of the feed screw, whereby the feed nut may return underneath the feed block of paper sheets for engagement with a pusher plate at said less advanced position.

6. The paper sheet feeder defined in claim 4, further including limit switch means actuated by arrival of the feed nut at a terminal retracted position remote from the singulator shingling mechanism, connected to stop the drive means.

7. The paper sheet feeder defined in claim 6, wherein said limit switch means include a deceleration switch actuated by the feed nut's arrival at a threshold position, and also a stop switch actuated by the pusher plate's arrival at a final stop position.

8. The paper sheet feeder defined in claim 3, further including limit switch means actuated by arrival of the pusher plate at a terminal advanced position near the singulator shingling mechanism, connected to stop the drive means.

9. The paper sheet feeder defined in claim 8, wherein said limit switch means include a deceleration switch actuated by the pusher plate's arrival at a threshold position, connected to slow the resupply feed screw drive means to a slow speed and to activate a flashing deceleration warning light, and also a stop switch actuated by the pusher plate's arrival at a final stop position, connected to stop the resupply feed screw drive means, and to activate a continuous warning light indicating that paper resupply is required.

10. The proper sheet feeder defined in claim 3, wherein the singulator shingling mechanism incorporates a delivery deck guiding the frontmost sheets of said feed block into contact with downwardly traversing segments of endless singulating belts tractively driving each frontmost sheet downward toward endless stream feeder feed belts carrying the sheets toward said infeed tray platform.

11. The paper sheet feeder defined in claim 10, wherein said delivery deck is provided with a deck ramp slanting downward at a predetermined angle and having a deck edge having notch means permitting intrusion of the singulating belts therein, tractively drawing each frontmost sheet in turn between said belts and said angled notches in an arched, buckled cross-sectional configuration, whereby fibre-lock adherence to an adjacent sheet is broken.

12. The paper sheet feeder defined in claim 11 wherein said predetermined angle may be adjusted by the user.

13. The paper sheet feeder defined in claim 10, wherein the singulator shingling mechanism further includes a central feed roller driven to urge a succeeding frontmost sheet downward overlappingly behind the previous frontmost sheet, for shingled stream delivery by the stream feeder feed belts.

14. The paper sheet feeder defined in claim 10, wherein, said singulator shingling mechanism incorporates a resiliently biased pivoting position sensor responsive to the arrival of the frontmost sheet of said feed block on the delivery ramp in contact with said singulator belts, connected for intermittently stopping said drive means.

15. The paper sheet feeder defined in claim 14 wherein said singulator shingling mechanism incorporates an overfeed sensor responsive to the advance of said feed block beyond the contact position, connected to disconnect said drive means in an emergency stop mode until the overfeed condition is corrected.

16. The paper sheet feeder defined in claim 10 wherein said stream feeder is provided with a sheet support plate underlying the leading edges of all sheets delivered to the infeed tray platform by the stream feeder feed belts.

17. The paper sheet feeder defined in claim 10 wherein said stream feeder is provided with an adjustable position guide having roller means depressing the stream of shingled sheets delivered by the stream feeder feed belts to present their leading edges under the trailing edges of the previously delivered sheets.

18. The paper sheet feeder defined in claim 10, further including a level sensor bar resting on the trailing edge of the topmost delivered sheet stacked on said infeed tray platform, and a feed control switch, actuated by the raising of the level sensor bar by a predetermined height of stacked sheets, connected to stop the operation of the singulator shingling mechanism until the stacked sheet height is reduced by a predetermined number of sheets taken by the printing machine from the infeed tray platform.

* * * * *